United States Patent [19]

Kirschke

[11] 4,222,975

[45] Sep. 16, 1980

[54] APPARATUS AND PROCESS FOR REPAIRING UNDERGROUND GASOLINE TANKS

[76] Inventor: John A. Kirschke, P.O. Box 125, Boerne, Tex. 78006

[21] Appl. No.: 917,729

[22] Filed: Jun. 21, 1978

[51] Int. Cl.[2] ..... E02D 3/14; E04H 7/02

[52] U.S. Cl. ..... 264/35; 264/36; 264/265; 405/264; 405/267

[58] Field of Search ..... 264/35, 36, 265; 405/57, 264, 267; 138/97, 98

[56] References Cited

U.S. PATENT DOCUMENTS

| | | | |
|---|---|---|---|
| 3,293,864 | 12/1966 | Hagius | 405/269 X |
| 3,351,289 | 11/1967 | Demaison | 264/30 X |
| 3,351,460 | 11/1967 | Demaison | 264/30 |
| 3,814,645 | 6/1974 | Fletcher | 264/36 X |
| 3,950,461 | 4/1976 | Levens | 264/46.9 X |
| 4,022,935 | 5/1977 | Kinney | 138/97 X |
| 4,112,690 | 9/1978 | Hosoya | 405/57 |

*Primary Examiner*—Thomas P. Pavelko
*Attorney, Agent, or Firm*—Gunn & Lee

[57] ABSTRACT

The apparatus to practice the method of this invention is particularly effective in repairing underground gasoline storage tanks which have fractures or perforations directly underneath the filler pipe. A boring and injection tool projects down the filler pipe and perforates and seals adjacent the bottom of the storage tank. A soil stabilizer is injected into the area adjacent and exterior of the underground storage tank. The chemicals project into the pea gravel surrounding the tank and polymerize or solidify to stop infiltration or exfiltration. A sanding tool is next utilized to remove the glaze from the interior of the fiber glass tank. Water is evacuated from the tank and an air jet cleaning tool is utilized to remove the film of water from the area to be repaired. Next, an epoxy injection tool is utilized to deposit epoxy over the area to be repaired. Epoxy solidifies to the inner wall of the tank repairing the perforated or fractured area.

8 Claims, 11 Drawing Figures

APPARATUS AND PROCESS FOR REPAIRING UNDERGROUND GASOLINE TANKS

BACKGROUND OF THE INVENTION

1. Field of the Invention

This invention pertains to the sealing of the inside of a tank after the stabilizing of soil around an underground storage tank to stop infiltration or exfiltration through a hole or fracture in the tank. Further steps of the process are to prepare the interior of the tank for sealing and the final step is to inject epoxy into the interior of the tank over the perforation or fracture restoring or repairing the structure of the tank.

2. Description of the Prior Art

Various methods have been developed for stabilizing soil or creating water impervious barriers in areas of permeable earth formations. One such development is the patent to Levy et al., U.S. Pat. No. 3,608,318, which involves the method and apparatus for injecting asphalt in the soil to create barriers. A closely analogous injection tool is Lonaberger et al., U.S. Pat. No. 2,960,831, designed for simultaneously injecting of two chemicals into the soil for stabilization. The patent to Linberg, U.S. Pat. No. 2,235,937, employs a rubber membrane to cover a leak or perforation in the wall of the tank and subsequently covers the rubber membrane with a layer of cement. This patent has some similarity to the development of this invention.

The prior art tools or methods do not disclose the boring and injection tool of this invention to stabilize the pea gravel on the exterior of an underground gasoline storage tank. The method of removing the water film from the area to be repaired employs a novel tool and method. The specific structure of the sanding tool for removing the jell coat glaze from the interior of a fiber glass underground gasoline storage tank as well as the air jet cleaning tool for removing the water film from the area of the tank to be repaired employs equipment and methods not taught by the prior art.

SUMMARY OF THE INVENTION

Underground storage tanks 10 frequently develop fractures or leaks 13 directly below the filler pipe 12. In fiber glass tanks, repeated shock of the measuring stick projecting through filler pipe 13 fatigues and creates fractures in the bottom of tank 10. In metal tanks, erosion and electrolysis accelerated or facilitated by the measuring stick creates a similar problem in metal tanks. When an underground storage tank 10 has developed a fracture or leak 13, exfiltration or infiltration must be inhibited to repair or seal the tank 10. This invention accomplishes this by placing a boring and injection tool 14 down the filler pipe 12 rotating the tool 14 projecting into the bottom of the tank 10. After this is accomplished, two chemical tanks are connected to the boring and injection tool 14. One tank contains five gallons of water; PWG powder which comprises 8.3 pounds of acrylamide and N,N'-methylenebisacrylamide, and 1/24 ounces of Uranine Flourescein, Halliburton part no. 70.15385; and 32 ounces of Catalyst "D" which is Beta-dimethylaminopropionitrile, Halliburton part no. 70.15384. The second tank contains five gallons of water and eight ounces of SP Ammonium Persulfate. Another combination which might be used is Minnesota Mining and Manufacturing Co. 3M C.R.201 in one tank and water in the second tank. By applying air pressure to the two tanks, these chemicals are injected through the apertures in the tip of the boring and injecting tool 14 into the pea gravel 11 surrounding the fiber glass tank. The two chemicals meet and combine in the voids in the pea gravel 11 creating a fluid impervious barrier. After the sealing of the tank 10 on its exterior surface, the repair process may be initiated. Sanding tool 33 is inserted through filler pipe 12 and rotated to remove the glaze from the interior surface of the fiber glass tank. Water is next removed from the interior of the tank, either by pumping or small quantities are removed utilizing a vacuum tank 40 connected to the vacuum hose 42 having a suction tip 43. The next step is to insert an air jet cleaning tool 45 thorugh filler pipe 12 and jet the final film of water away from the area to be repaired. Three jet apertures 46 in the air jet cleaning tool 45 create a ventura-like action removing the water and pulling gasoline over the area to be repaired. Gasoline in no way inhibits the bonding of epoxy to the fiber glass. Following this jetting process, epoxy may be injected into the area to be repaired with an epoxy injection tool 47. After a curing period of 45 minutes or more, the tank is essentially sealed. Longer curing increases the effectiveness and durability of the seal. Experiments on sample repair structures reflect that the epoxy to fiber glass bond is more permanent and structurally stronger than the fiber glass resin structure. Sections of the tank are torn away before the bond between the fiber glass and epoxy will release.

BRIEF DESCRIPTION OF THE DRAWINGS

For a description of the apparatus and method of this invention, reference is made to the attached drawings wherein identical reference characters will be utilized to refer to identical or equivalent components throughout the various views, the foregoing summary, and the detailed description.

DESCRIPTION OF THE PREFERRED EMBODIMENT

Figure 1:
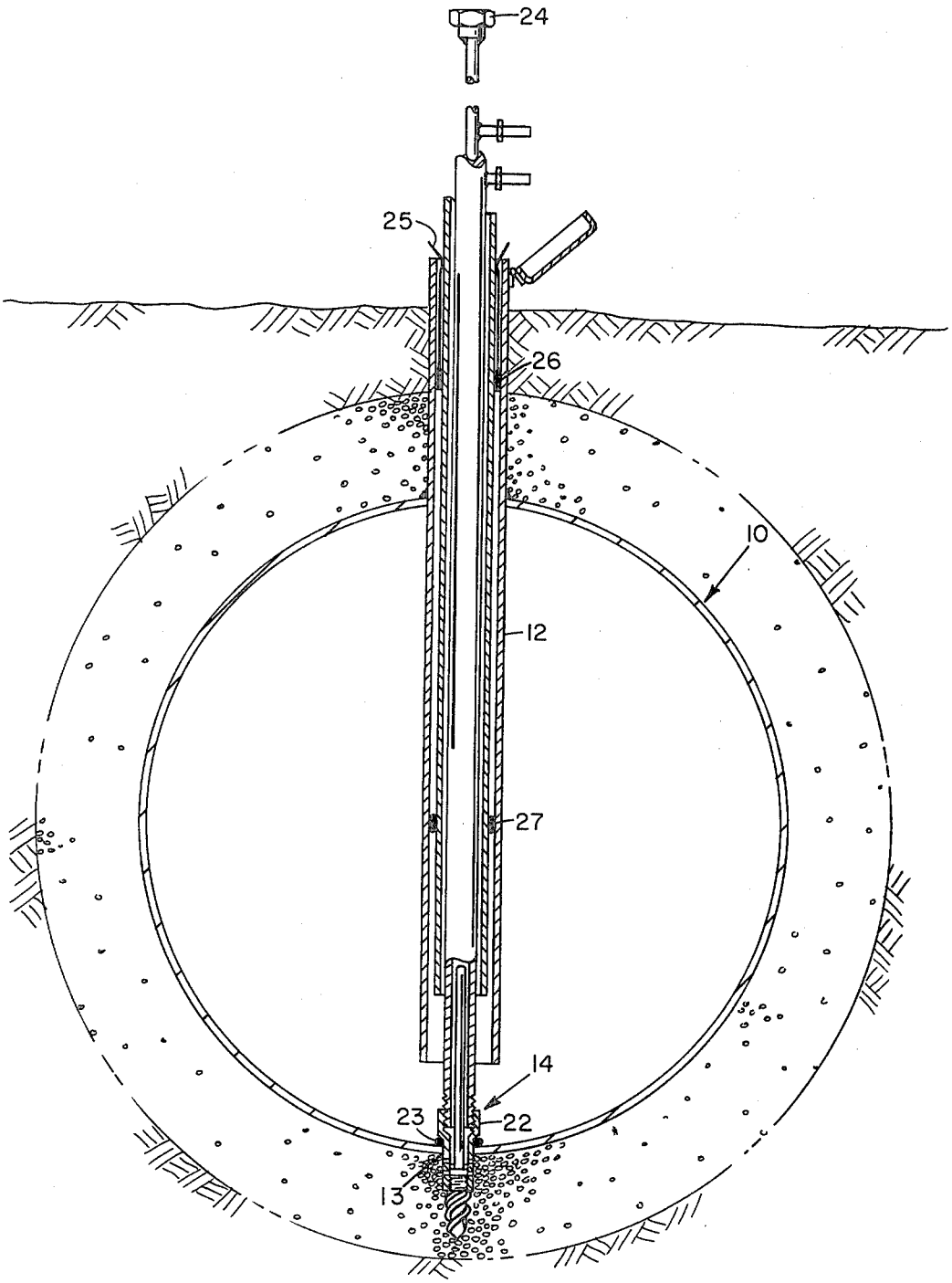
FIG. 1 is a sectional view through an underground gasoline storage tank sectionalized at the filler pipe disclosing a boring and injection tool and tool guide in position simulating boring and sealing of the exterior of the tank.
Figure 2:
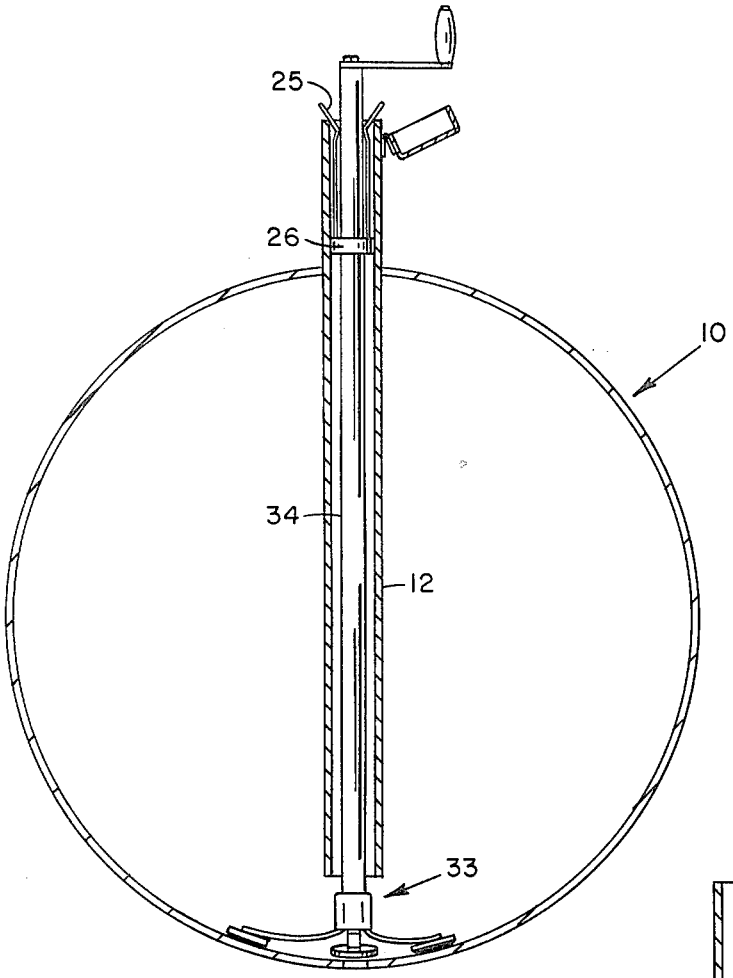
FIG. 2 is a sectionalized view of an underground storage tank, at the filler pipe, with a tool guide and sanding tool in a simulated position for sanding the interior of a fiber glass tank.
Figure 3:
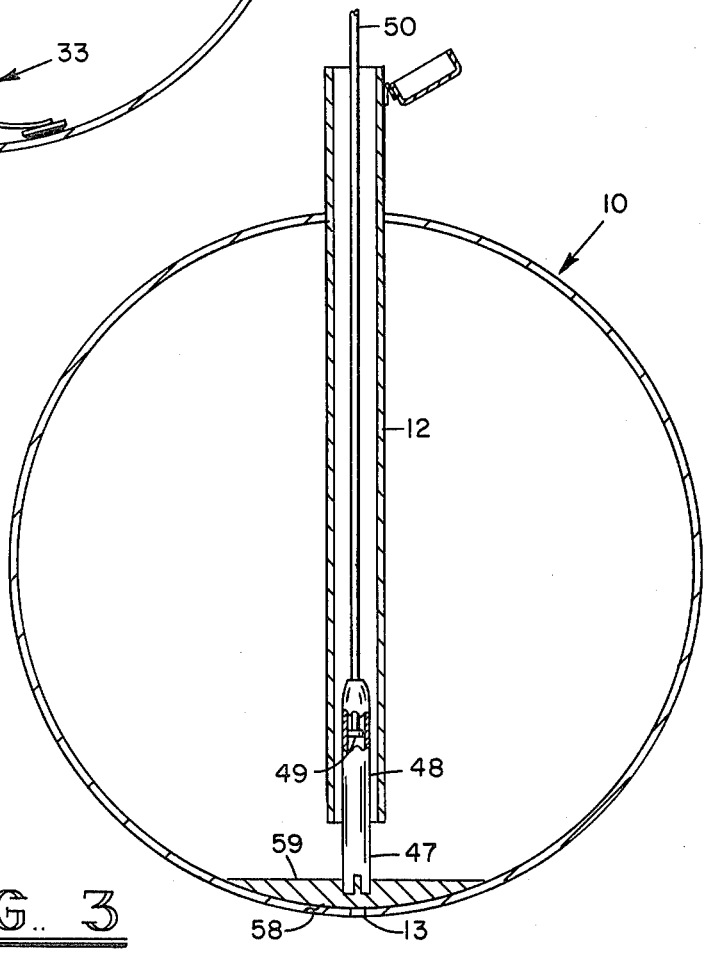
FIG. 3 is a sectionalized view of an underground gasoline storage tank sectionalized through the filler pipe schematically illustrating an epoxy injection tool in position simulating the injecting of epoxy and the repair of the interior of the tank.
Figure 4:
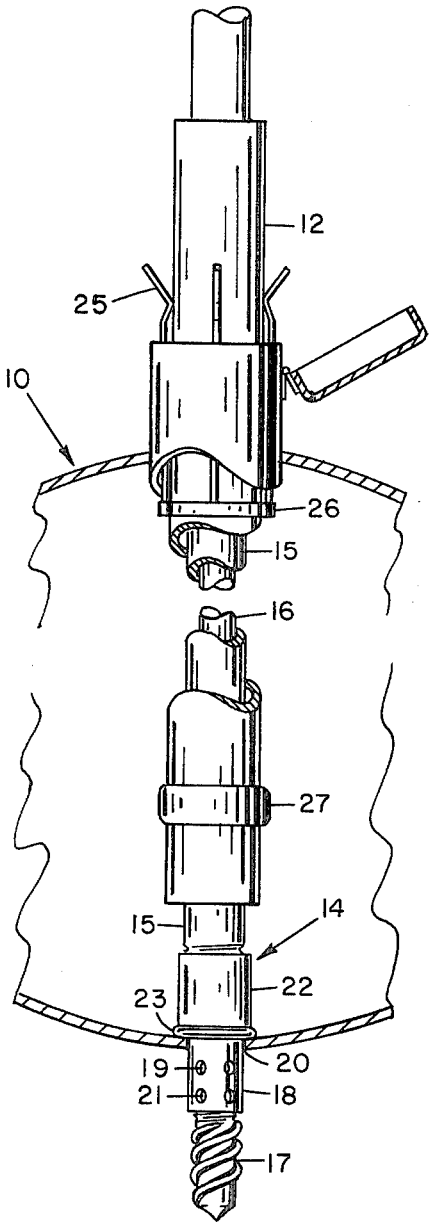
FIG. 4 is a partially sectionalized and fragmented view illustrating some of the details of the construction of the boring and injection tool.

The apparatus and method of this invention is designed for sealing and repairing underground storage tanks 10 as illustrated in FIGS. 1–3. The apparatus and method may be utilized for repairing steel tanks as well as being particularly applicable for the repair of fiber glass underground storage gasoline tanks. In a normal emplacement, the fiber glass underground storage tank 10 is embedded in twelve inches of pea gravel 11 of a grade not smaller than ⅛" in diameter or larger than ¾" in diameter. These underground storage tanks 10 are normally constructed with an integrally constructed filler pipe 12 utilized for filling the tanks 10 as well as the access aperture for the tools in performing the process of this invention. The measuring stick (not shown) by constantly contacting the bottom of tank 10 creates fractures or perforations 13 in the tank directly below filler pipe 12. In repairing these tanks, a boring and injection tool 14, as illustrated in FIGS. 1 and 4, is employed. This tool 14 is normally attached to an outer pipe 15 1" in diameter and 16' in length. An inner pipe 16 of ½" diameter of stainless steel is positioned interior of outer pipe 15. This permits boring and injection in one continuous operation. The tip of the tool 14 comprises a bit 17 which projects downward from a collar 18. This collar 18 is constructed with a series of injection holes 19. The base injection holes 20 are adjacent the collar 18 and communicate with the outer pipe 15. The tip injection holes 21 communicate with the inner pipe 16 with the base injection holes 20 and the tip injection holes 21 being separated by an "O" ring or other structure to prevent the add mixing of the chemicals prior to their entering the soil. Collar 18 is constructed with a collar shoulder 22 of a diameter larger than 1". This collar shoulder 22 is against an "O" ring 23 normally retained in a groove adjacent collar shoulder 22. The foregoing structure retains and seals the boring and injection tool 14 adjacent the interior surface of the underground storage gasoline tank 10 when in position preventing the escape of fluid to or from the interior of storage tank 10. The boring and injection tool 14 is normally constructed or adapted to receive a rotating means 24 which may be a conventional crank for rotating and boring a fiber glass tank or might utilize an adapter for receiving an electric drill for boring metal tanks.

Figure 5:
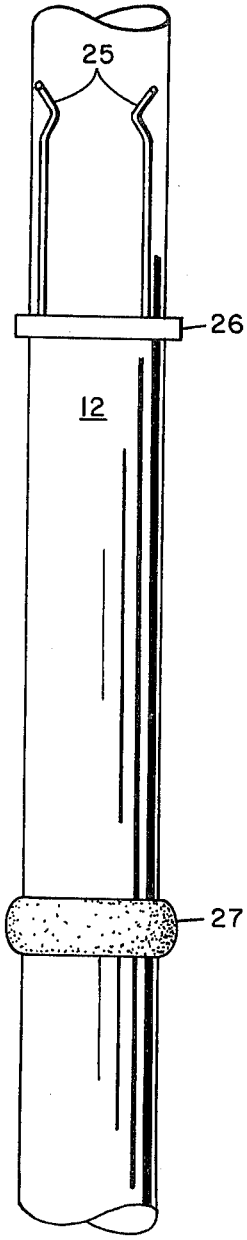
FIG. 5 is a sectionalized, partially fragmented view illustrating some of the details of the construction of the tool guide.
Figure 6:
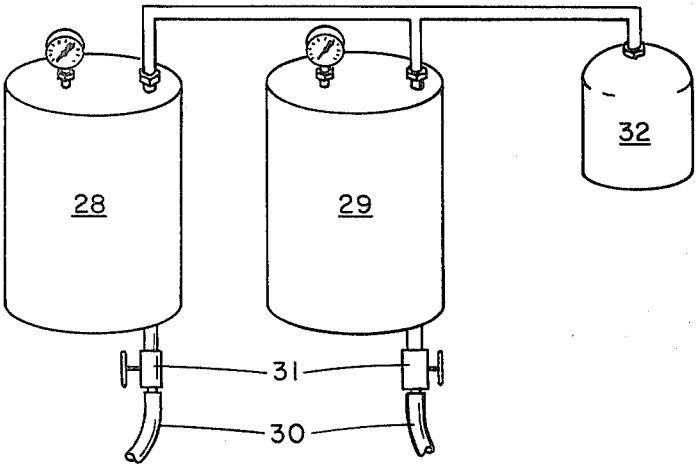
FIG. 6 is a plan view partially schematic of the chemical tanks used in conjunction with the boring and injecting tool of FIG. 1 and FIG. 4.

Another item of equipment utilized is a 2" tool guide 25 which is an elongated tubular structure as illustrated in FIG. 5 designed for positioning and retaining the working tools in filler pipe 12. The top of tool guide 25 is constructed with a centering collar 26 as substantially illustrated in FIG. 5. Tool guide 25 for additional stability may be constructed with a lower collar 27 when desired. In conjunction with utilization of the boring and injection tool 14, the first chemical tank 28 and a second chemical tank 29 with associated chemical hoses 30 and chemical connector 31 is required. Some external source of compressed air 32 is required to pressurize and power the chemical tanks 28 and 29. In practicing the process of this invention, first chemical tank 28 contains chemicals mixed in the proportions of 5 gallons of water; PWG powder which comprises 8.3 pounds of acrylamide and N,N'=methylenebisacrylamide, and Beta-dimethylaminopropionitrile; with the second chemical tank 29 containing chemicals in the proportion of 5 gallons of water and 8 ounces of SP which is Ammonium Persulfate. In practice, it has been found that 2 gallons of the chemical are normally sufficient for sealing the exterior of one underground storage tank.

Figure 8A:
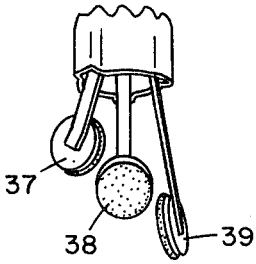
FIG. 8*a* is a side view of the sanding tool illustrating the sanding head in a folded position for insertion through the filler pipe.
Figure 8B:
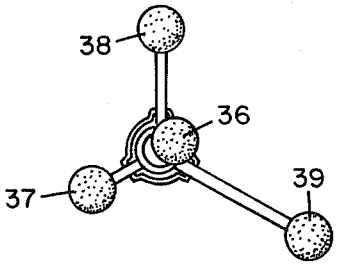
FIG. 8*b* is a bottom view illustrating the working surfaces of the sanding tool, particularly illustrating the sanding arms and the sanding pads.

After sealing the exterior of the underground storage tank 10 against exfiltration of gasoline or infiltration of water, the interior of the underground storage tank should be prepared for epoxy sealing. This accomplished by sanding the area of tank 10 to be repaired utilizing sanding tool 33 as illustrated in FIGS. 2 and 8. Sanding tool 33 utilizes a sanding shaft 34 which is approximately 2½ inches in diameter and 16 feet long. Sanding tool 33 is constructed with a sanding collar 35 similar in construction to centering collar 26 of tool guide 25. Normally, a structure similar to lower collar 27 is not employed in sanding tool 33. This permits some wandering of the lower end of sanding tool 33 thereby increasing the area of sanding. The sanding end of sanding tool 33 comprises a center sanding pad 36 which is 2" in diameter and positioned slightly off-center. For this construction and arrangement, reference is made to FIG. 8. The shorter sanding arm 37 is 3½" in length; the intermediate sanding arm is 5½" in length and the long sanding arm 39 is 7½" in length. This structure sands and produces an oblong surface in the interior of storage tank 10 having a configuration consistent with the normal flow of the epoxy repair material.

Figure 7:
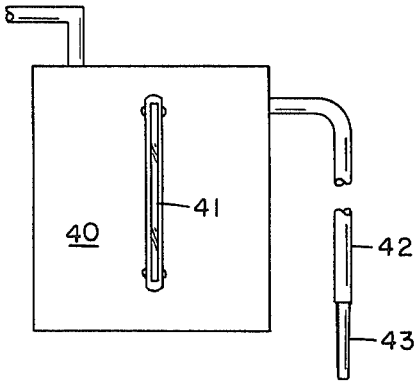
FIG. 7 is a plan view of the vacuum tank, vacuum hose partially fragmented and suction tip utilized in removing residual water from a gasoline storage tank.
Figure 9:
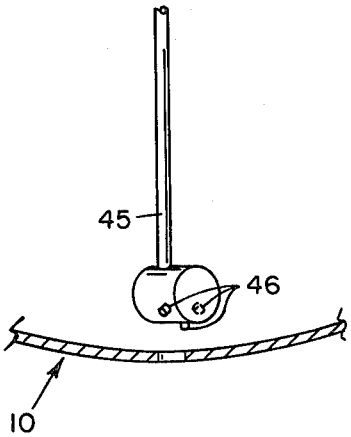
FIG. 9 is a plan view partially fragmented and partially sectionalized of the air jet cleaning tool.
Figure 10:
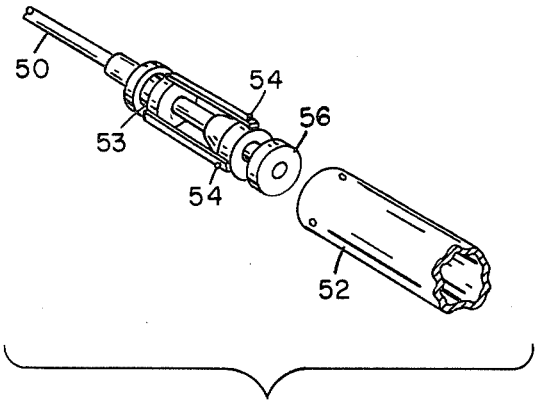
FIG. 10 is an exploded view of an epoxy injection tool incorporating a disposable cylinder and a quick connect plunger and drive rod.

After the sanding process is completed, if substantial quantities of water are in the underground storage tank 10, the water is removed by a conventional pump truck (not shown or described). The last residual water in the bottom of the tank is stripped from the tank utilizing a vacuum tank 40 as illustrated in FIG. 7. This vacuum tank 40 in the preferred embodiment was a 42-gallon tank constructed with a sight gauge 41 with a 25-foot vacuum hose 42 connected to a vacuum tank 40 with a one inch section of PVC pipe connected to the end of vacuum hose 42 forming a suction tip 43. After stripping the final residue of water from the bottom of storage tank 10, an air jet cleaning tool 45 is connected to an external source of compressed air which may be compressor 32. Air jet cleaning tool 45 is constructed with three jet apertures 46 to flare out in a fan-like configuration from the exhaust end of air jet cleaning tool 45. These jets 46 have an air aperture of 15/1000" to perhaps 30/1000" depending on the volume of compressed air available. The general construction and arrangement of air jet tool 45 is as substantially illustrated in FIG. 9. In the operation of the preferred embodiment, it has been found that the utilization of the air jet cleaning tool 45, in its configuration, forms a jetting of venturi-like effect over the area being cleaned removing the water and water film and pulling gasoline over the area moistening the sanded surface to be sealed with gasoline. The effect of this is to deposit a film of gasoline on the surface to which is desired that epoxy adhere assuring a good bond. Gasoline does not inhibit the adhering of epoxy whereas water does. After the surface is sanded and prepared for sealing, the charge of epoxy must be prepared and injected through the filler pipe 12. A charged epoxy injection tool 47 is placed in position through the filler pipe 12 as illustrated in FIG. 3. Epoxy injection tool 47 is constructed in two configurations. The first comprises a two inch two foot long cylindrical barrel 48 having a plunger 49 which is driven by a plunger drive rod 50 which is activated by hand from the surface discharging the epoxy from cylinder 48 to the surface to be repaired as illustrated in FIG. 3. After utilization of the metal epoxy injection tool 47, the tool should be cleaned with solvent before the epoxy sets. In the course of perfecting this invention, a disposable configuration of this tool has been developed. For illustration of the structure, reference is made to FIG. 10. This tool comprises a disposable cylinder 52 which is constructed of 2-inch PVC pipe, a quick connect adapter 53 was constructed having three quick connect arms 54 which engage disposable cylinder 52. This connection of the pin and hole type structure that flares out and engages the walls of disposable cylinder 52. The quick connect structure has a plunger 55 which includes a neopreme disposable pad 56 which may be disconnected from the plunger 55 and disposed of along with disposable cylinder 52. This structure essentially requires no cleanup with solvent to preserve the tools in a continuing, operable condition. Fracture area of underground storage tank is repaired by permitting the epoxy to set for approximately 45 minutes or longer for additional strength. Tank section 57 including the tank fracture 58 and the epoxy patch 59 adheres and sets in an integral structure wherein the bond between the epoxy patch 59 and the tank section 57 has a strength greater than the internal structure of the fiber glass underground storage tank 10.

METHOD AND OPERATION OF THE DEVICE

The method and operation is perhaps rather self-evident from a reading of the foregoing description of the various tools employed and the operation of the individual tools. From a method or process standpoint, the steps of the repair procedure could be said to be step one injecting a soil stabilizer and catalyst into the soil adjacent the fractured area of an underground storage tank. Second, sanding or preparing the fractured area for internal sealing. This step may well comprise removal of water from the area to be repaired. An air jetting of remaining moisture away from the fractured area with a third step of injecting epoxy into the tank over the fractured area sealing the interior of the tank. In practicing this invention, the first step of the process is perhaps the key to its success. In the event of exfiltration, if the exterior of the tank were not sealed by the stabilizer stopping exfiltration, the epoxy would bubble out through the fracture from the pressure of content of storage tank 10, perforating the epoxy resulting in a hole in the epoxy patch. In a similar fashion, if we are experiencing an infiltration from external water through the fracture, water would continue to flow in through the fracture and infiltrate or perforate the newly applied epoxy patch causing a bubbling like hole into the interior of storage tank 10. It is self-evident that the flow of fluid to or from the tank must first be stopped before this process or repair procedure can be effectively practiced or applied.

PROCESS FOR REINFORCING FIBER GLASS STORAGE TANKS

Experiments and testing of repaired or reinforced tanks reveal considerable merit in the repaired structure. The strength and durability of the fiber glass tanks 10 with the epoxy patch 59 is stronger and more durable than original, new tanks 10. Tanks may be reinforced or repaired on the surface as well as prior to installation. This reinforcing process would comprise the steps of sanding the interior surface of the tank 10, cleansing the area to be reinforced and applying a thick epoxy patch 59 to the sanded area.

Having described and illustrated the tools, the apparatus, and their utilization as well as having described in sequence the steps of the process as well as the specialized tools employed in association therewith, what is desired to be claimed is the apparatus and the method or process of this invention, not departing from the scope of equivalents of the invention as defined in the appended claims.

I claim:

1. In a method and apparatus for repairing imbedded underground gasoline storage tanks partially filled with a hydrocarbon, said tank having a filler pipe extending from said tank to a remote position from said tank, the steps of:

a. sanding through said filler pipe the interior of the area of the tank to be repaired below the said filler pipe of the said underground storage tank, and b. injecting through said filler pipe epoxy interior of said tank in the area of the tank to be repaired.

2. The method of claim 1 wherein the epoxy is injected through the said filler pipe utilizing an injector tool extending through said filler pipe contacting the interior of the said underground gasoline storage tank in prolongation of the said filler pipe.

3. The invention of claim 1 wherein said hydrocarbon is a distillate fuel.

4. The method of claim 1 including the additional step of removing substantially all water from the interior of said tank in the area to be repaired.

5. The method of claim 4, including the additional step of air jetting all water away from the interior of said tank in the area to be repaired.

6. The method of claim 1 including the additional preliminary step of perforating the said underground storage tank through the said filler pipe utilizing a boring and injection tool.

7. The method of claim 6 including the step of injecting a fluid soil stabilizer through said boring and injecting tool.

8. The method of claim 1 wherein the said soil stabilizer includes acrylamide, N,N'-methylenebisacrylamide, Beta-dimethylaminopropionitrile, and Ammonium Persulfate.

* * * * *